US009162088B2

(12) United States Patent
Patil et al.

(10) Patent No.: US 9,162,088 B2
(45) Date of Patent: Oct. 20, 2015

(54) METHOD OF ASSEMBLY AND DISASSEMBLY OF ABRASIVE BLAST RESPIRATOR

(71) Applicants: Swapnil Gopal Patil, Maharashtra (IN); Joseph Rodrigues, Cranston, RI (US); Joseph Venagro, Cranston, RI (US)

(72) Inventors: Swapnil Gopal Patil, Maharashtra (IN); Joseph Rodrigues, Cranston, RI (US); Joseph Venagro, Cranston, RI (US)

(73) Assignee: Honeywell International Inc., Morristown, NJ (US)

( * ) Notice: Subject to any disclaimer, the term of this patent is extended or adjusted under 35 U.S.C. 154(b) by 234 days.

(21) Appl. No.: 13/683,745

(22) Filed: Nov. 21, 2012

(65) Prior Publication Data

US 2014/0115864 A1 May 1, 2014

Related U.S. Application Data

(63) Continuation-in-part of application No. 13/683,013, filed on Nov. 21, 2012.

(30) Foreign Application Priority Data

Oct. 25, 2012 (IN) ..... 3291/DEL/2012

(51) Int. Cl.
*A62B 18/08* (2006.01)
*A62B 18/04* (2006.01)

(52) U.S. Cl.
CPC ..... *A62B 18/04* (2013.01); *A62B 18/082* (2013.01); *Y10T 29/49876* (2015.01)

(58) Field of Classification Search
CPC ..... A26B 23/02; A62B 17/006; A62B 18/04
USPC ..... 128/201.25, 201.29, 200.24, 201.23, 128/202.13, 206.12, 206.16, 206.24
See application file for complete search history.

(56) References Cited

U.S. PATENT DOCUMENTS

| | | | | |
|---|---|---|---|---|
| 2,529,106 | A | 11/1950 | Schauweker | |
| 3,291,126 | A | 12/1966 | Messick | |
| 3,739,774 | A | 6/1973 | Gregory | |
| 3,963,021 | A | 6/1976 | Bancroft | |
| 4,127,130 | A | 11/1978 | Naysmith | |
| 4,256,386 | A | 3/1981 | Herbert | |
| 4,414,973 | A | 11/1983 | Matheson et al. | |
| 4,494,538 | A | 1/1985 | Ansite | |
| 4,542,538 | A | 9/1985 | Moretti et al. | |
| 4,592,350 | A | 6/1986 | Maryyanek et al. | |
| 4,648,394 | A | 3/1987 | Wise | |
| 4,846,166 | A * | 7/1989 | Willeke | 128/200.24 |

(Continued)

OTHER PUBLICATIONS

MSA The Safety Company: Advantage® 4000 Abrasi-Blast™ Respirator, Information Sheet, msanet.com, 8 pages.

(Continued)

*Primary Examiner* — Richard Chang
(74) *Attorney, Agent, or Firm* — Conley Rose, P.C.; Kristin Jordan Harkins

(57) ABSTRACT

Embodiments of methods of assembling an abrasive blast respirator are disclosed. The method may comprise removably attaching an exhalation valve into an exhalation valve port of a facepiece, removably installing the facepiece into a hood, removably attaching a filter to a first inhalation valve, where the first inhalation valve is coupled to the facepiece, and removably attaching a breathing hose to a second inhalation valve, where the second inhalation valve is coupled to the facepiece.

19 Claims, 10 Drawing Sheets

(56) References Cited

U.S. PATENT DOCUMENTS

| | | | | |
|---|---|---|---|---|
| 4,873,972 | A | | 10/1989 | Magidson et al. |
| 4,886,058 | A | | 12/1989 | Brostrom et al. |
| 4,930,539 | A | | 6/1990 | van Rooy |
| 4,961,420 | A | | 10/1990 | Cappa et al. |
| H863 | H | | 1/1991 | Kwiedorowicz |
| 4,989,598 | A | | 2/1991 | Berg et al. |
| 5,299,448 | A | | 4/1994 | Maryyanek et al. |
| 5,431,156 | A | | 7/1995 | Sundstrom |
| 5,549,104 | A | * | 8/1996 | Crump et al. ..... 128/201.25 |
| 6,102,033 | A | | 8/2000 | Baribeau et al. |
| 6,408,845 | B1 | | 6/2002 | Pereira et al. |
| 7,293,560 | B2 | | 11/2007 | Dahrendorf et al. |
| 7,464,705 | B2 | | 12/2008 | Tanizawa et al. |
| 7,762,252 | B2 | | 7/2010 | Prete |
| 7,975,688 | B1 | | 7/2011 | Truitt |
| 8,028,695 | B2 | | 10/2011 | Acker et al. |
| 8,176,913 | B2 | | 5/2012 | Ivory |
| 8,402,966 | B2 | | 3/2013 | Morgan, III et al. |
| 8,707,472 | B2 | | 4/2014 | Stachler et al. |
| 2009/0194101 | A1 | | 8/2009 | Kenyon et al. |
| 2009/0241965 | A1 | | 10/2009 | Sather et al. |
| 2009/0266361 | A1 | | 10/2009 | Bilger et al. |
| 2010/0287688 | A1 | | 11/2010 | Stachler et al. |
| 2011/0036347 | A1 | | 2/2011 | Morgan, III et al. |
| 2012/0152255 | A1 | | 6/2012 | Barlow et al. |
| 2014/0116429 | A1 | | 5/2014 | Patil et al. |
| 2014/0116430 | A1 | | 5/2014 | Patil et al. |

OTHER PUBLICATIONS

CLEMCO; www.clemcoindustries.com, Job No. 2317-0506, Rev. C 0111; Apollo 600 Supplied-Air Respirator for Abrasive Blasting; 4 pages.

rpb® nova 3®, Ultra Performance, Heavy Industry Respirator, IS99001 Accredited Company; www.rpbsafety.com; 4 pages.

Bullard 88VX™ Series Airline Respirator User Manual; 20 pages.

* cited by examiner

METHOD OF ASSEMBLY AND DISASSEMBLY OF ABRASIVE BLAST RESPIRATOR

CROSS-REFERENCE TO RELATED APPLICATIONS

This application claims priority to India Provisional Patent Application Serial No. 3291/DEL/2012, filed Oct. 25, 2012 in the India Patent Office.

This application is a continuation in part of U.S. patent application Ser. No. 13/683,013, entitled "Abrasive Blast Respirator", filed Nov. 21, 2012 in the U.S. Patent Office, which is incorporated herein by reference in its entirety to the extent it does not conflict with this disclosure.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Abrasive blasting is a common surface preparation technique used in ship building, ship maintenance, and other industrial activities to remove old paint and other surface materials such as rust, mill scale, dirt, salts, and other impurities. In some contexts this procedure may be referred to as sand blasting. The abrasive blasting may be conducted to prepare a surface for painting and/or for treatment with a corrosion inhibitor. In abrasive blasting, compressed air may be used to propel abrasive material and to direct the abrasive material on the work area at a relatively high velocity. The operator or blaster may manipulate a wand that comprises a nozzle for directing the abrasive material. In some applications, air pressure used in blasting may be as high as 100 PSI, and nozzle velocities of abrasive material may be between 650 feet per second to 1,700 feet per second. Abrasive blasting may be conducted in confined spaces.

During abrasive blasting, abrasive material may bounce back or ricochet onto the blasting operator. Further, during abrasive blasting, a blasting operator may be subjected to a direct blast, for example if one blasting operator accidently directs a blast on another blasting operator or if a blasting operator drops his blasting tool, and the blasting tool directs the blast upon the blasting operator. It is prudent, and may be required by law and/or regulation, that the blasting operator use respiratory protection, eye protection, and face protection while blasting to avoid injury from either ricochet bounce back or direct blasting.

SUMMARY

In an embodiment, a method of assembling an abrasive blast respirator is disclosed. The method comprises removably attaching an exhalation valve into an exhalation valve port of a facepiece, removably installing the facepiece into a hood, removably attaching one or more filter to one or more (first) purified air inhalation valve, where the (first) purified air inhalation valve is coupled to the facepiece, and removably attaching a breathing hose to a (second) supplied air inhalation valve, where the supplied air inhalation valve is coupled to the facepiece.

In another embodiment, a method of disassembling an abrasive blast respirator is disclosed. The method comprises detaching a breathing hose from a first inhalation valve, where the first inhalation valve is coupled to a facepiece of an abrasive blast respirator external to a hood, detaching a filter from a second inhalation valve, where the second inhalation valve is coupled to the facepiece external to the hood, and removing the facepiece out of a hood assembly of the abrasive blast respirator.

In another embodiment, a method of assembling an abrasive blast respirator is disclosed. The method comprises removably installing a full facepiece assembly into a hood, wherein the full facepiece assembly comprises a lens, a face seal, and a head harness, removably attaching a protective cover to an outside of the full facepiece assembly external to the hood and over a plurality of inhalation valves and/or exhalation valve, and removably attaching a lens magazine assembly to the lens after the full facepiece assembly is installed into the hood.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Exemplary methods of assembly, disassembly, and manufacturing of an abrasive blast respirator are taught herein. The structure and configuration of an exemplary abrasive blast respirator are described first, before describing the methods of assembly, disassembly, and manufacturing, as a general understanding of the structure of the exemplary abrasive blast respirator contributes to ease of understanding the description of the methods. For further details about an exemplary abrasive blast respirator see patent application Ser. No. 13/683,013, entitled "Abrasive Blast Respirator", filed Nov. 21, 2012, which is incorporated by reference in its entirety to the extent it does not conflict with this disclosure.

Figure 1:
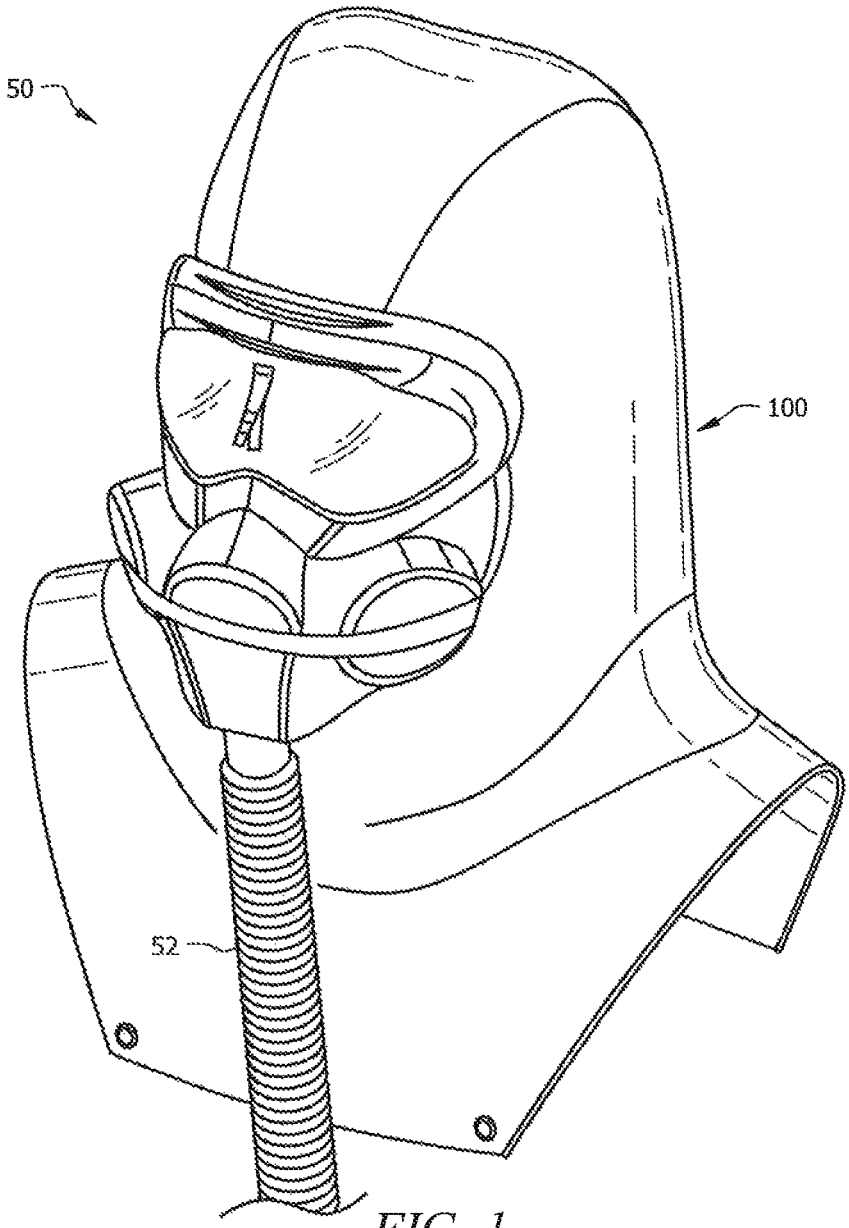
FIG. 1 is an illustration of an exemplary abrasive blast respirator according to an embodiment of the disclosure.

Turning now to FIG. 1, an abrasive blast respirator 50 is described. In an embodiment, the abrasive blast respirator 50 comprises a breathing hose assembly 52 and a respirator assembly 100. The abrasive blast respirator 50 is suitable for use in performing abrasive blasting operations, for example for cleaning and/or preparing metal surfaces for painting and/or applying anti-corrosion materials. In an embodiment, the abrasive blast respirator 50 may be employed in ship maintenance and building operations. The abrasive blast respirator 50 may be employed in refinery maintenance and building operations. The abrasive blast respirator 50 may be employed in other operations as well. The abrasive blast respirator 50 may be configured to provide protection to an abrasive blast operator, providing respiratory protection, eye protection, and face protection.

The abrasive blast respirator 50 may be used for blasting operations by an operator working in tight quarters, for example crawling between pipes, in the interior of a small enclosure, or other confined space. In an embodiment, the abrasive blast respirator 50 may afford a wide field of view for the user. The abrasive blast respirator 50 may comprise a soft, deformable hood that flexes somewhat as the blast operator moves, which may promote increased comfort under some operating conditions. Typically, the hood does not contain rigid hood protection, such as a helmet, since the bulk and rigidity of a helmet might restrict a user's access to tight or confined spaces. The breathing hose assembly 52 of FIG. 1 typically attaches to a front of the abrasive blast respirator 50; a configuration that may reduce entanglement problems that otherwise might be experienced if a breathing hose were attached to a back of an abrasive blast respirator.

Figure 2:
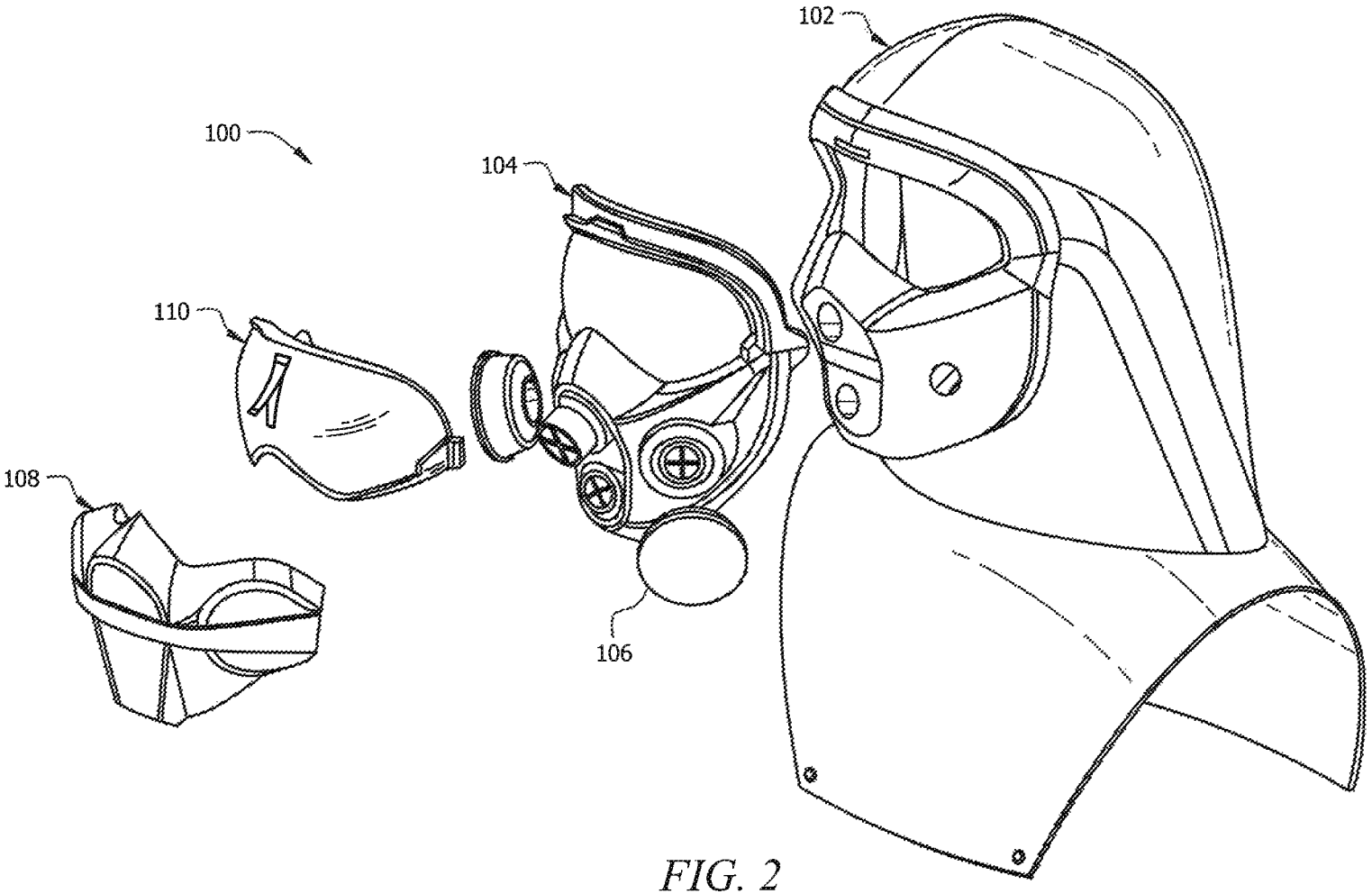
FIG. 2 is an illustration of some major components of an exemplary abrasive blast respirator according to an embodiment of the disclosure.

Turning now to FIG. 2, further details of the respirator assembly 100 are described. In an embodiment, the respirator assembly 100 may comprise a hood assembly 102, a full facepiece 104, one or more releasably attached filters 106, a releasably attached protective cover 108 (typically covering/protecting one or more elements on the front of the facepiece 104, which might for example be external to the hood), and a releasably attached lens magazine or cartridge 110. The filter(s) 106 may attach threadedly, by a snap fit, or by another releasable attachment means to a purified air inhalation valve coupled to or forming a component of the full facepiece 104. In an embodiment, the filter(s) 106 comprises a housing enclosing a filter media. The filter(s) 106 provides an air flow path from an exterior opening of the housing, through the filter media, and out an interior opening of the housing where the filter(s) 106 releasably attaches to the full facepiece 104. While two filters 106 are illustrated in FIG. 2, in an embodiment one filter 106 or more than two filters 106 may be releasably attached to the full facepiece 104. In an embodiment, the filter 106 provides a back-up source of air to a user of the supplied-air abrasive blast respirator 50 in the event that the breathing hose assembly 52 becomes inoperable for supplying air, for example if the hose becomes kinked or severed. In an embodiment, the filter(s) 106 may comprise a P100 filter made by North/Honeywell. Typically, the one or more filters 106 are located on the front of the facepiece during use, external to the hood. Such a location may simplify performing a seal check. Typically, a removable cover 108 (as shown in FIG. 2) might be removably attached over the filter(s) 106, to allow ready access while also protecting the filter(s) 106 from the abrasive blast environment. The removable cover in some embodiments might cover the filter(s), the exhalation valve, and/or the supplied-air inhalation valve (attachment point of breathing hose to the facepiece), and in some embodiments one or more protective covers could be removably attached to the front of the facepiece. Typically, the removable cover is separate and/or apart from the hood and, when in place on the facepiece, is external from the hood.

The lens magazine 110 may be releasably attached to the full facepiece 104 by mating flexible tabs on a carrier lens component of the lens magazine 110 to corresponding slots or detents in the full facepiece 104. The releasably attached protective cover 108 may be configured to snap over the one or more filters 106 and/or other elements exposed on the front of the facepiece 104. It is contemplated that the protective cover 108 and the lens magazine 110 may be released and attached to the full facepiece 104 by a blast operator who is wearing the abrasive blast respirator 50. Further, it is contemplated that the protective cover 108 and the lens magazine 110 may be released and attached by the gloved hand of the operator while wearing the abrasive blast respirator 50. And with respect to the lens magazine 110, release of one or more removable lenses from the lens magazine 110 and/or release of the lens magazine 110 from the facepiece 104 may be accomplished using a single (gloved) hand of the operator. The protective cover 108 desirably comprises a material that is resistant to erosion by abrasive particles and protects the filter 106 and other features of the full facepiece 104. In an embodiment, the protective cover 108 may comprise nylon 6 material. In another embodiment, however, the protective cover 108 may comprise material other than nylon 6. Further, the protective cover 108 desirably is configured to allow ready flow of air around its edges, for example around its lower edge, to permit air flow into the filter 106 and air flow out of an exhalation valve coupled to or forming a component of the full facepiece 104. The protective cover 108 of FIG. 2 typically is separate and apart from the hood 102, located external to the hood, and typically interacting with the facepiece 104 independently of the hood 102 and/or mask. Typically, the protective cover shields the filter(s), the exhalation valve, and/or the supplied air inhalation valve (attachment of breathing hose to facepiece). In some embodiments, a plurality of covers might be used.

Figure 3:
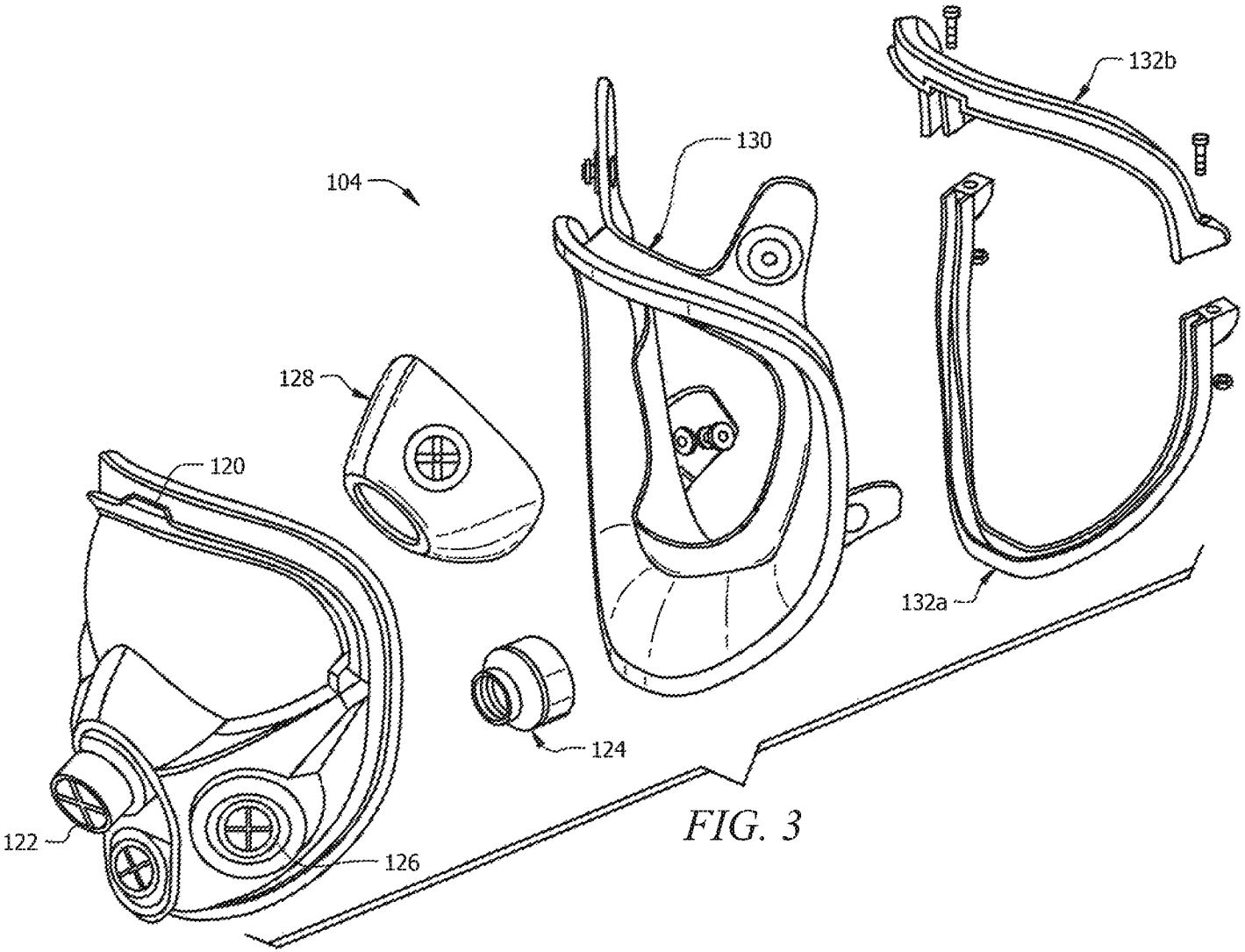
FIG. 3 is an illustration of some components of a full facepiece assembly of an exemplary abrasive blast respirator according to an embodiment of the disclosure.

Turning now to FIG. 3, further details of the full facepiece 104 are described. In an embodiment, the full facepiece 104 may comprise a base lens 120 (having viewing area with a field of vision), an exhalation valve 122, a first (supplied-air) inhalation valve 124, a second (purified air) inhalation valve(s) 126, a nose cup 128, a face seal 130, and a clamp 132 comprising an upper clamp **132*b* and a lower clamp 132*a*. The clamp 132 secures the lens 120 to the face seal 130. The upper clamp 132*b* and the lower clamp 132*a* may be placed to hold the lens 120 and the face seal 130 together, and the upper clamp 132*b* may be attached to the lower clamp 132*a* using screws, rivets, adhesive, snaps, or other retaining structure. In an embodiment, the upper clamp 132*b*** and the lower clamp

132*a* may be manufactured of Polyphenylene Sulfide. The lens 120 may comprise a locating feature to promote ease of installing the full facepiece 104 into the hood assembly 102, for example a tab at the top of the lens 120 that corresponds to a slot in a protective mask portion of the hood assembly 102.

A harness (not shown but typically having adjustable straps) may be coupled to the face seal 130 by buttons, rivets, buckles, or other coupling structure. The harness may be used to secure the face seal 130 to a face of a user of the abrasive blast respirator 50. The harness may be adjusted to prevent air flow around the interface of the face seal 130 with the user's face. For example, the straps of the harness may be tightened while the facepiece is position with respect to the user's face, to form a seal.

The lens 120 may be made of a material that resists impacts, and the lens 120 typically provides a relatively wide field of vision, for example at least 160 degrees of vision. By providing a greater field of vision, the abrasive blast respirator 50 may promote a user seeing to either side without turning his or her head, for example when tight quarter interfere with turning his or her head. Additionally, a wide field of vision may simplify seal check testing, especially when one or more elements that require interaction for seal check(s) are located on the front of the facepiece external to the hood (and for example located beneath the lens viewing area). The user may then utilize visual cues when performing seal checks. The lens 120 typically may be configured to provide good optical qualities. In an embodiment, the lens 120 may comprise polycarbonate material, for example Lexan 103R. One of ordinary skill in the art will appreciate that the lens 120 might be constructed using other materials.

Figure 4:
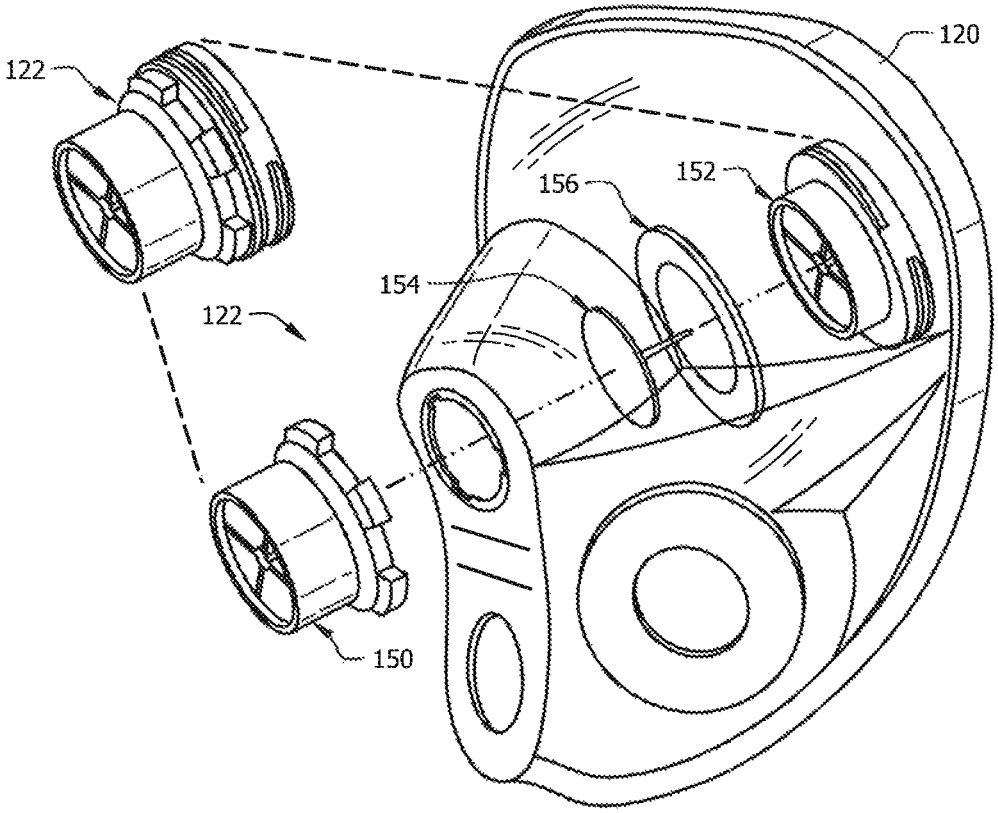
FIG. 4 is an illustration of an exemplary exhalation valve component of the full facepiece assembly according to an embodiment of the disclosure.

Turning now to FIG. 4, details of an exemplary exhalation valve 122 are described. In an embodiment, the exhalation valve 122 comprises a valve cover 150, a valve 154, a seal 156, and a valve housing 152. In an embodiment, the valve cover 150 is removably attached to the valve housing 152 by a snap fit, but in another embodiment the valve cover 150 may be releasably attached to the valve housing 152 or to the lens 104 by a different structure. The valve housing 152 may retain the seal 156 and the valve 154 when the valve housing 152 is releasably attached to the lens 104. In an embodiment, the valve housing 152 is releasably attached to the lens 104 by inserting through an aperture in the lens 104 and turning the valve housing 152 until it snaps into position. The valve housing 152 may have tabs that fit into cut outs in a lip of the aperture in the lens 104 and that engage with the lip as the valve housing 152 is rotated. In an embodiment, the configuration of the tabs on the valve housing 152 and the cut outs or slots in the lip of the aperture in the lens 104 is designed to limit insertion of the valve housing 152 into the aperture in the lens 104 to the preferred angular rotational position of the valve housing 152. In an embodiment, the valve cover 150 and the valve housing 152 comprise NORYL SE1x, GE material. In an embodiment, the seal 156 may comprise closed cell Epiclorohydren (ECH) foam. One of ordinary skill in the art will appreciate that the components of the exhalation valve 122 might be constructed using other materials. The exhalation valve 122 typically functions to allow air exhaled by a user wearing the respirator to exit while preventing external air from entering the respirator through the exhalation valve 122. The exhalation valve 122 may typically be located on the front of the facepiece 104, external to the hood. Such a location may provide ready access for performing seal checks (without, for example, having to move or reconfigure the hood from its standard abrasive blasting configuration). Typically, however, such an exhalation valve 122 might be shielded from the abrasive blasting environment by a protective cover 108 (as shown for example in FIG. 2) that may be removably attached to the facepiece 104.

Figure 5:
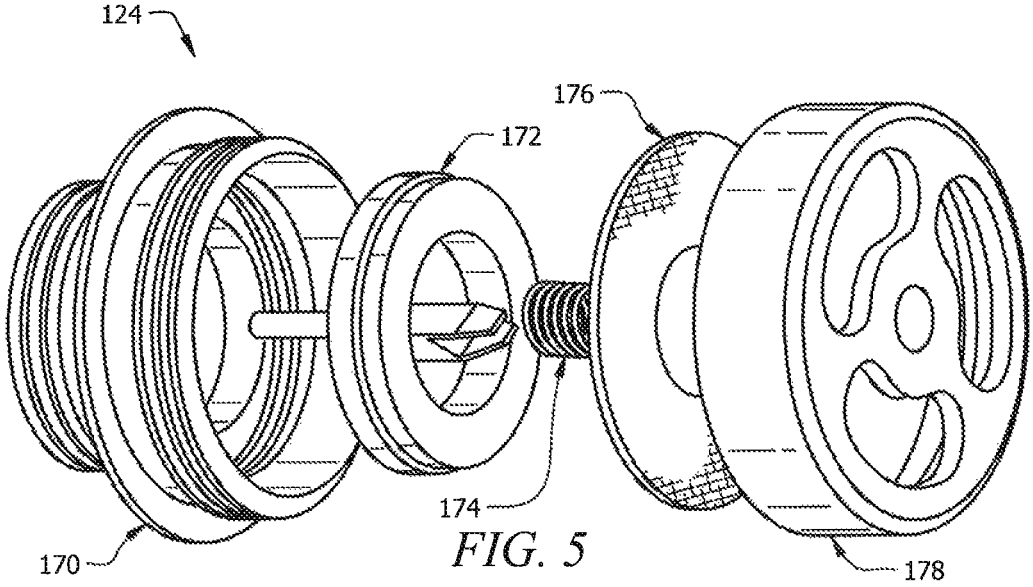
FIG. 5 is an illustration of an exemplary inhalation valve of the full facepiece assembly according to an embodiment of the disclosure.

Turning now to FIG. 5, further details of an exemplary inhalation valve 124 are described. In an embodiment, the inhalation valve 124 comprises a housing 170, a stem 172, a spring 174 or other biasing member (biasing the valve closed), an optional felt washer 176 (which may provide noise reduction), and a cover 178. In an embodiment, the housing 170, the stem 172, and the cover 178 may be comprised of Acetal (Delrin) and may be machined and/or molded. The stem 172 may further comprise a rubber seal component. The optional felt washer 176 may be provided to attenuate noise due to turbulence. One of ordinary skill in the art will appreciate that the components of the inhalation valve 124 might be constructed using other materials. The inhalation valve 124 typically functions to allow supplied air (typically provided via a breathing hose) to enter the respirator, but preventing air from leaving the respirator. Additionally, the inhalation valve 124 of FIG. 5 might operate to prevent any air from entering the respirator though the inhalation valve 124 if the breathing hose is compromised. For example, if pressure in the breathing hose drops below a set limit (for example 1-2 PSI), the inhalation valve 124 may close and prevent any external air from entering the respirator through the inhalation valve 124. The inhalation valve 124 may typically be located on the front of the facepiece, external to the hood. Such as location may provide ready access (for attachment of the breathing hose, for example), without for example having to move or reconfigure the hood from tit standard abrasive blasting configuration. Typically, such as inhalation valve might be shielded by a protective cover that may be removably attached to the facepiece.

The housing 170 may be retained in an aperture of the lens 104 by a gasket, for example a flexible rubber gasket. The stem 172, spring 174, and optional felt washer 176 may be assembled into the housing 170 while the housing 170 is retained in the aperture of the lens 104 and then the cover 178 may be coupled to the housing 170 to retain the inhalation valve 124 in a spring biased state. For example, the cover 178 may be screwed over the housing 170. When the cover 178 is coupled to the housing 170, the cover and housing 170 cooperate to retain the inhalation valve 124 in the lens 104.

Figure 6:
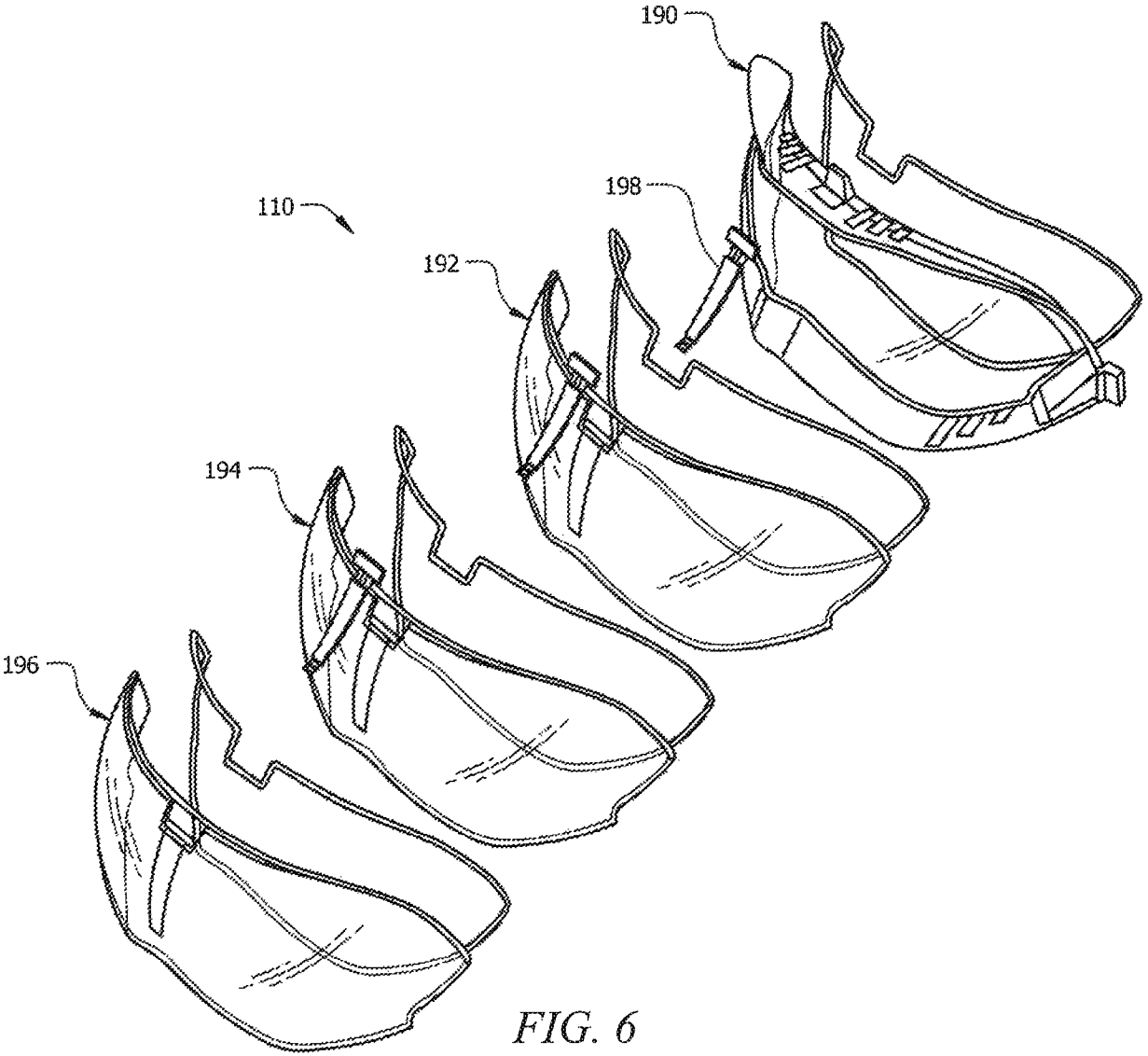
FIG. 6 is an illustration of an exemplary lens magazine or cartridge of the abrasive blast respirator according to an embodiment of the disclosure.

Turning now to FIG. 6, further details of an exemplary lens magazine 110 are described. In an embodiment, the lens magazine 110 may comprise a carrier lens 190, an inner lens 192, a middle lens 194, and an outer lens 196 (or any number of removable, sacrificial lenses atop the carrier lens 190). While the lens magazine 110 is described as having three sacrificial lenses (atop the carrier lens), in other embodiments the lens magazine 110 may have one lens, two lenses, three lenses, or four or more lenses. In a preferred embodiment, the lenses 192, 194, 196 are not interchangeable but are configured to fit into a specific ordered position in the lens magazine 110. In some embodiments, the lenses may include a gasket seal between adjacent lenses, and typically the gasket is securely attached to the inner surface of the outermost lens of an adjacent pair of lenses, but is not firmly attached to the outer surface of the innermost lens of the adjacent pair (but is pressed into sealing position). Thus the gasket seal may be removed (in its entirety) when the outermost lens is removed from the lens magazine. Typically, a robot might apply the gasket seal to the inner surface of the outermost lens of an adjacent pair of lenses in automated fashion. Often, the gasket seal material would then be cured prior to being placed in contact with the outer surface of the innermost lens in the adjacent lens pair. In an embodiment, the optical properties of the lenses 192,194, 196 may each be individually designed to take into account the other lenses and their optical interactions. In an embodiment, the lenses 192, 194, 196 are configured to have high impact resistance. In an embodiment, the lenses 192, 194, 196 may comprise polycarbonate material. One of ordinary skill in the art will appreciate that the lenses 192, 194, 196 might be constructed using other materials.

The lenses 192, 194, 196 of FIG. 6 are configured to be releasably attached to the carrier lens 190. In an embodiment, the lenses 192, 194, 196 snap into and out of retaining slots or detents formed in the carrier lens 190. The lens magazine 110 may further comprise tabs 198 (typically located on the front of a lens, perhaps in the middle towards the top edge of the lens) that are coupled to each of the lenses 192, 194, 196. For example, the tabs 198 may insert through slots in the lenses 192, 194, 196 and project out. It is contemplated that a user of the abrasive blast respirator 50 may grasp the tab 198 with a (single) gloved hand, for example when wearing the abrasive blast respirator 50 and during a working assignment, and remove the coupled lens 192, 194, 196 to expose the next underlying lens 192, 194, 196. The user may remove a lens 192, 194, 196 that has been damaged by abrasive ricochet and/or blast and hence is difficult to see through clearly. Removing the outermost lens 192, 194, 196 may allow the user to see through an as yet undamaged middle lens 194 or inner lens 192. Preferably the lens magazine 110 affords at least a 160 degree field of vision to the user of the abrasive blast respirator 50. The carrier lens 190 of FIG. 6 is configured to removably attach to the base lens of the respirator facepiece, for example by snap attachment.

Figure 7:
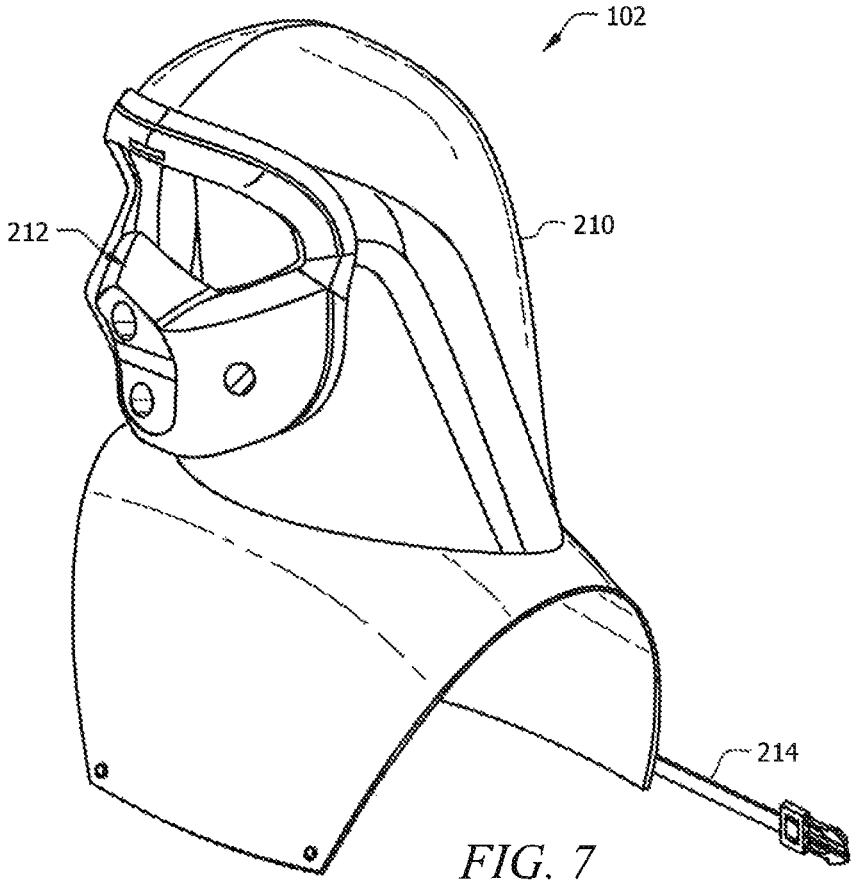
FIG. 7 is an illustration of an exemplary hood assembly of the abrasive blast respirator according to an embodiment of the disclosure.
Figure 8:
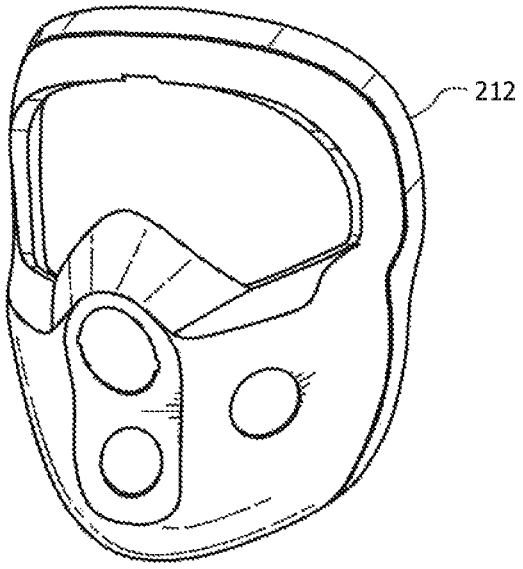
FIG. 8 is an exemplary protective mask portion of the hood assembly according to an embodiment of the disclosure.
Figure 9:
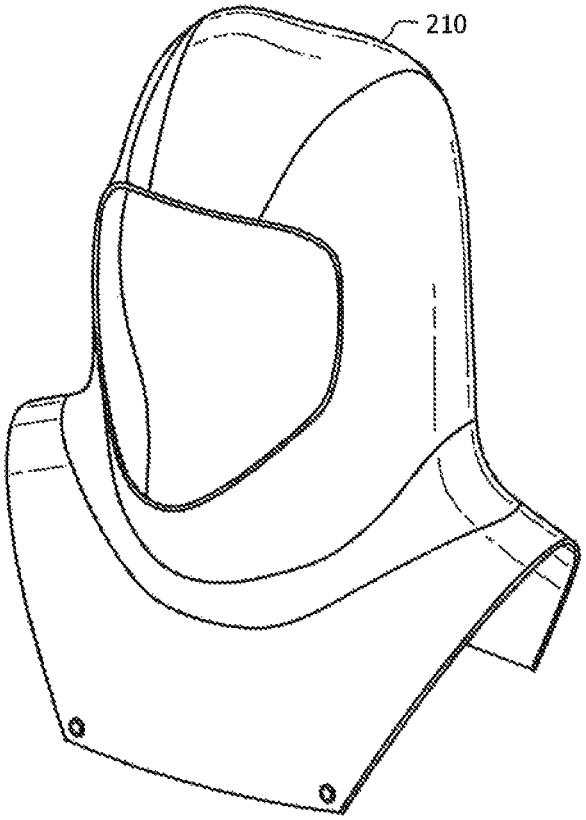
FIG. 9 is an illustration of an exemplary hood of the hood assembly according to an embodiment of the disclosure.

Turning now to FIG. 7, FIG. 8, and FIG. 9 further details of the hood assembly 102 are described. In an embodiment, the hood assembly 102 may comprise a hood 210, a protective mask 212, and one or more optional sternum straps 214. The sternum straps 214 may have a buckle component at one end that mates with a corresponding buckle component coupled to an underside or inside of the front portion of the hood 210 (or snaps or buttons might be used). The sternum straps 214 may be employed to hold the hood assembly 102 and the abrasion blast respirator 50 in place as the user has adjusted it when donning the abrasion blast respirator 50, for example to maintain a comfort of the user, to reduce the likelihood of abrasive grit entering under the hood, and to maintain an effective seal between the face of the user and the face seal 130.

The protective mask 212 may be formed of a material that protects the lower portion of the full facepiece 104 from direct blast and/or ricochet of abrasive particles. In an embodiment, the protective mask 212 may comprise TPU material Versollan RU 2205-9. The protective mask 212 may be provided with apertures that interact with elements on the facepiece, for example receiving valves and/or filters attached to or coupled to the full facepiece 104 when it is installed into the hood assembly 102. In an embodiment, the protective mask 212 may be sewn to the hood 210. Alternatively, the protective mask 212 may be welded and/or riveted to the hood 210.

In an embodiment, the hood 210 may be formed from one or more sheets of material that may be cut and sewn or otherwise coupled at cut edges to form the desired hood shape. In an embodiment the hood 210 may comprise Urethane or Mesathane 1509 reinforced with polyester.

Figure 10:
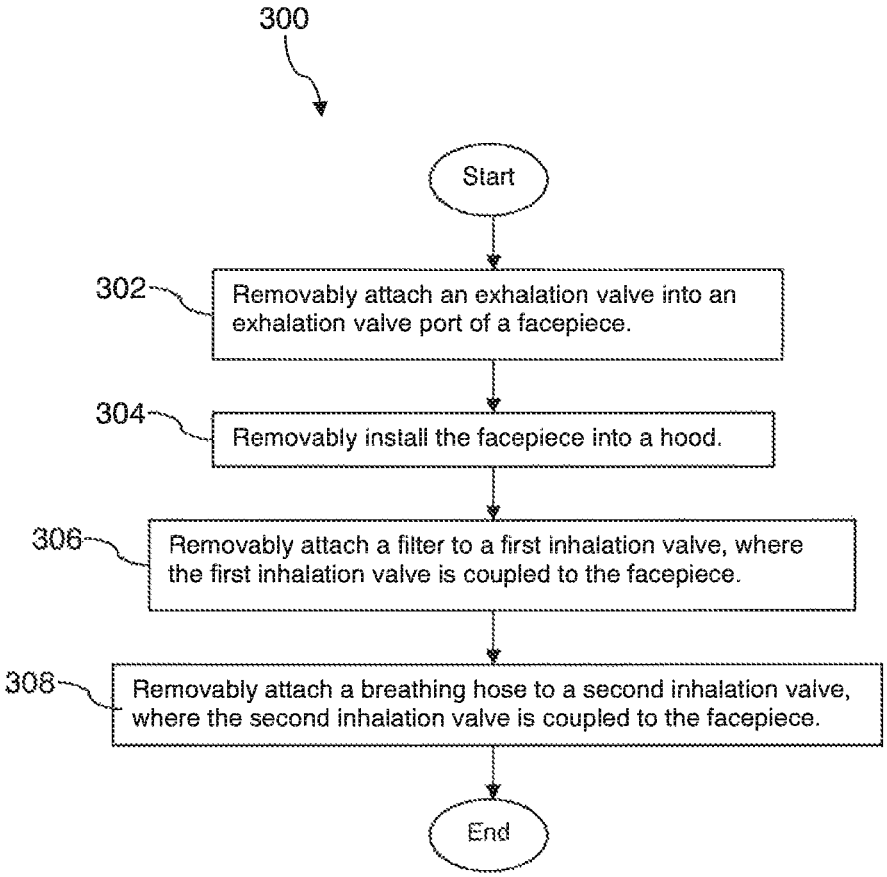
FIG. 10 is a flow chart of a method according to an embodiment of the disclosure.

Turning now to FIG. 10, an exemplary method 300 is described. At block 302, an exhalation valve may be removably attached to an exhalation valve port of a facepiece. At block 304, the facepiece may be removably installed into a hood. For example, the full facepiece 104 may be installed from an inside of the hood assembly 102, aligning a locating tab in the full facepiece 104 (for example in the upper edge of the lens 120) with a locating slot in the hood assembly 102 (for example in the upper edge of the protective mask 212). In an embodiment, installing the full facepiece 104 into the hood assembly 102 may comprise stretching and/or bending the deformable edges of the protective mask 212 to fit into receiving tracks molded into the lens 120. Typically, one the facepiece is installed onto the hood, the exhalation valve would be external to the hood. At block 306, a filter may be removably attached to a first (purified air) inhalation valve, where the first inhalation valve typically may be coupled to the facepiece. For example, the filter 106 might be threaded onto an inhalation valve. At block 308, a breathing hose may be removably attached to a second (supplied air) inhalation valve, where the second inhalation valve typically may be coupled to the facepiece. For example, a fitting coupled to an end of the breathing hose 52 might be screwed onto the inhalation valve 124. Typically, the breathing hose 52 and/or supplied air inhalation valve might be external to the hood once assembled. In an embodiment, at block 306 a first filter might be removably attached to the first inhalation valve and a second filter might be removably attached to a third inhalation valve. In other words, the respirator might have a plurality (for example, two) of filters, typically attached to purified air valves/ports located on the front of a facepiece, external to the hood once assembled. In an embodiment, the method 300 might further comprise removably attaching a protective cover over the filter(s) and/or the place where the breathing hose is removably attached to the second inhalation valve and/or the exhalation valve. In an embodiment, the method 300 may further comprise removably attaching a lens magazine to the facepiece. In an embodiment, the lens magazine 110 may be loaded with one or more (typically a plurality, for example 3-5) lenses by releasably attaching lenses 192, 194, 196 to the lens magazine 110.

Figure 11:
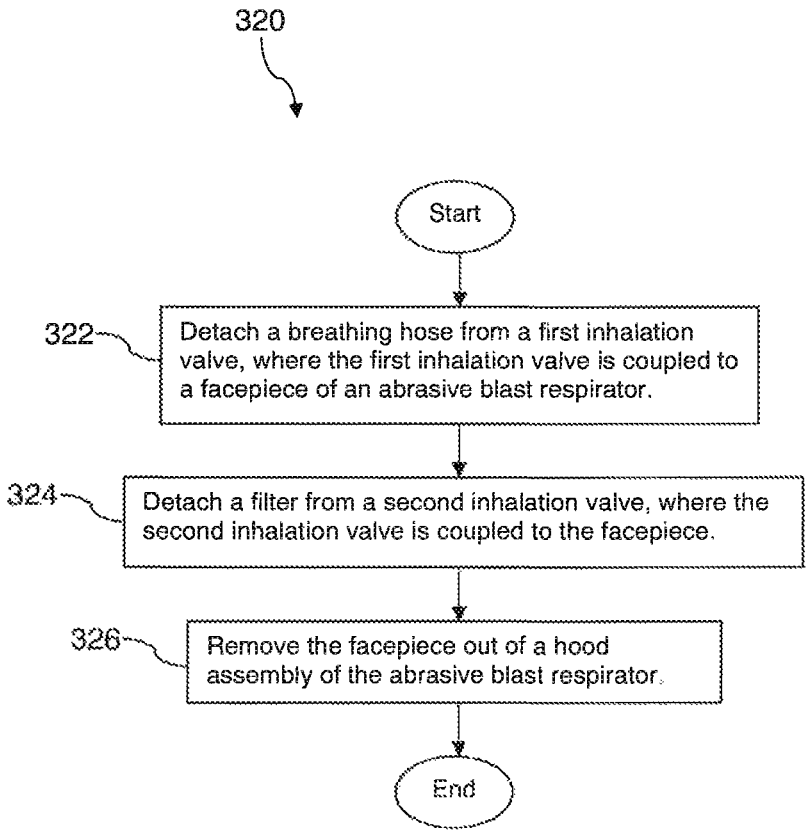
FIG. 11 is a flow chart of another method according to an embodiment of the disclosure.

Turning now to FIG. 11, an exemplary method 320 is described. At block 322, the user might detach a breathing hose from a first (supplied air) inhalation valve, where the (first) supplied air inhalation valve may be coupled to (the front of) a facepiece of an abrasive blast respirator external to the hood. In an embodiment, a lens magazine may be detached from the facepiece. At block 324, the user might detach a filter from a purified air (second) inhalation valve, where the purified air (second) inhalation valve is typically coupled to the (front of the) facepiece external to the hood. If a second filter is present, the user might also detach the second filter from another purified air (third) inhalation valve, where the third inhalation valve is typically coupled to the (front of the) facepiece external to the hood. At block 326, the user might remove the facepiece out of a hood assembly of the abrasive blast respirator. In an embodiment, removing the facepiece from the hood assembly may involve removing the facepiece by retracting it from the protective mask 212 into the inside of the hood 210. Further disassembly may be performed on the facepiece if desired. For example, a nose cup of the facepiece may be removed. For example, the inhalation valves may be disassembled. An exhalation valve may be disassembled by removing a valve cover from an exterior of the facepiece and a valve housing may be detached from an interior of the facepiece, for example by turning the valve housing about a quarter turn about an axis of the valve housing. When the abrasive blast respirator is disassembled, various components may be cleaned. The components, fittings, threads, tabs may have accumulated abrasive particles, and shaking the components may free these abrasive particles and clean the components. Compressed dry air may be used to blow off dirt and/or abrasive particles of various portions of the components, in some embodiments.

Figure 12:
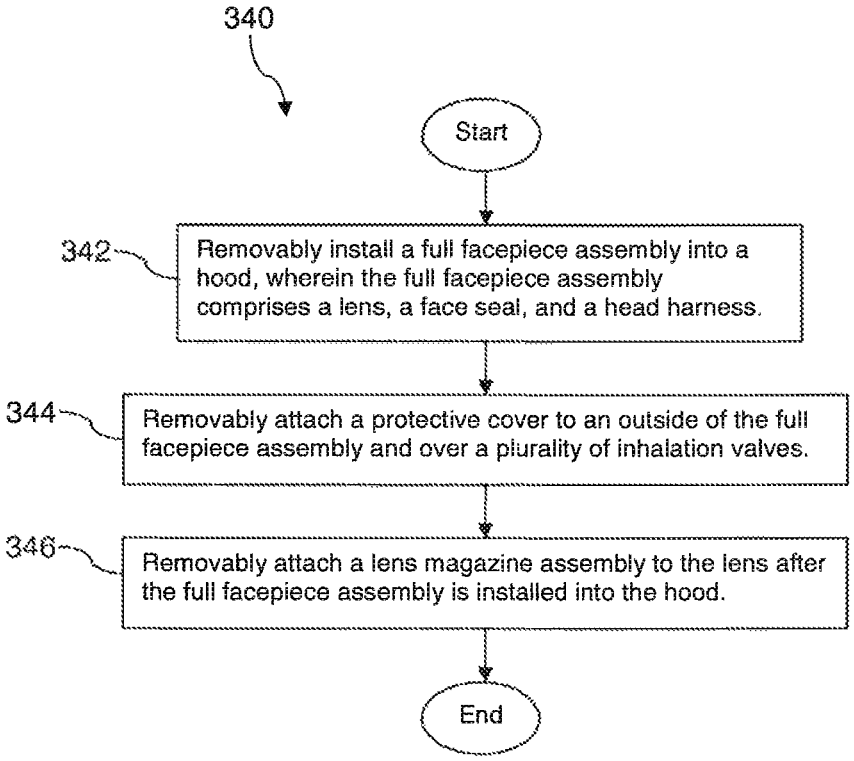
FIG. 12 is a flow chart of another method according to an embodiment of the disclosure.

Turning now to FIG. 12, an exemplary method 340 is described. At block 342, the user might removably install a full facepiece assembly into a hood, wherein the full facepiece assembly may comprise a lens, a face seal, and a head harness. The method may further comprise removably attaching one or more filters to purified air inhalation valves coupled to the full facepiece. The method may further comprise removably attaching a breathing hose to a supplied air inhalation valve coupled to the full facepiece. At block 344, the user might removably attach a protective cover to an outside of the full facepiece assembly and over a plurality of inhalation valves (wherein the protective cover is separate from the hood, and is typically located external to the hood once assembled). At block 346, the user might removably attach a lens magazine (cartridge) assembly to the lens after the full facepiece assembly is installed into the hood.

Typically, embodiments may include a (supplied air) inhalation valve (for attachment of a breathing hose), an exhalation valve, and/or one or more filters (typically attached to purified air inhalation ports or valves) located on the facepiece of the supplied air respirator, external to the hood. Such a location may allow for improved assembly/disassembly, since these elements may be more readily accessible without the need to move, reposition, reconfigure or otherwise interact with the hood. Also, locating one or more elements onto the front of the facepiece (and especially if located beneath the lens viewing area) may improve visual cues if interaction with the element(s) is ever necessary while the user is wearing the respirator.

Locating such elements on the facepiece, external to the hood may, however, expose them to increased wear and/or damage during blasting. Thus, attachment of the protective cover may improve utility. By making the protective cover removably attached, however, the user may still have ready access to the element(s) if needed (for example to perform seal checks). The protective cover may shield the supplied air inhalation valve (and/or connection to the breathing hose), the exhalation valve, and/or the one or more filters (and/or supplied air valves/ports).

The lack of rigidity of the hood may be useful in allowing the user of the respirator to access tight or confined spaces. Additionally, the flexible hood (without rigid elements) may aid in assembly/disassembly, installation, and/or removal of the respirator, by for example allowing the hood to be maneuvered easily with respect to the facepiece. Thus, the flexible hood may be pulled up to expose the straps of the harness attached to the rear of the facepiece (for easier attachment to the user's face), and then pulled down over the user's head for protection.

Typically, the facepiece with one or more elements may be inserted into the hood. The one or more elements on the facepiece might then be aligned with corresponding openings in the mask of the hood assembly. Such a configuration may allow the mask to provide some protection to the facepiece (shielding at least portions of the facepiece from abrasive blast environment), while also allowing the one or more elements on the facepiece to extend, interact with components or elements, or be located external to the hood. The facepiece and the hood assembly might then be joined into an integrated whole, and in some embodiments, the interaction of one or more of the elements with the facemask might assist in retaining the facepiece to the hood assembly. For example, the filter(s) might screw into purified air valves/ports in the facepiece, securing the mask therebetween.

In some embodiments, a lens magazine or cartridge might be removably attached to the base lens (viewing area) of the facepiece. Such a lens magazine may comprise a plurality of sacrificial lenses for protecting the base lens from the abrasive blast environment. The lenses can be removed one at a time as they are damaged (sufficiently to impair vision), and when all sacrificial lenses have been damaged, the lens magazine may be removed and replaced with a fresh/new lens magazine. And given the presence of two lens layers (for example the base lens of the facepiece and the carrier lens of the lens magazine), in some embodiments, the user may not need to wear protective eyewear.

In some embodiments, the breathing hose may attach to an inhalation valve in the facepiece (typically external to the hood) at one end, while the other end of the breathing hose may connect (be in fluid communication with) a housing block. Such a block might include a pressure relief valve and/or one or more muffler elements. Thus, a user might attach the breathing hose in such a way, providing a sealing valve at the top of the hose and a pressure relief valve and/or noise reduction element of the bottom of the hose.

The user might also place a porous airflow element, capable of altering the airflow pattern, within the inhalation valve and/or the breathing hose. Typically, such an airflow element might be placed in proximity to the exit of the supplied air inhalation valve, and/or in proximity to the entrance or inlet to the breathing hose (near the interface between the housing block and the breathing hose).

And in some embodiments, a user might attach a nose cap within (for example, to the inner surface of) the facepiece. The nose cap might be located so as to direct exhaled air from a user wearing the respirator towards the exhalation valve and/or away from the lens. The nose cap might be located to allow supplied air to enter the mask without interfering with or unduly influencing the exhalation valve.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of assembling a supplied-air abrasive blast respirator, comprising:

removably attaching an exhalation valve into an exhalation valve port of a facepiece;

removably installing the facepiece into a hood;

removably attaching one or more filter to one or more purified air inhalation valve, where the purified air inhalation valve is coupled to the facepiece; and removably attaching a breathing hose to a supplied air inhalation valve, where the supplied air inhalation valve is coupled to the facepiece; wherein the one or more filter and exhalation valve are located external to the hood;

wherein the hood comprises a mask with openings corresponding to the exhalation valve, one or more purified air valve, and supplied air inhalation valve; and wherein installing the facepiece into a hood comprises inserting the facepiece into the hood: aligning the facepiece with the mask so that the openings in the mask match with the corresponding exhalation valve, one or more purified air valve, and supplied air inhalation valve; and fitting the facepiece to an inner surface of the mask so that the mask shields portions of the facepiece, while allowing the one or more filter, at least a portion of the exhalation valve, and the breathing hose attachment to the supplied air inhalation valve to be located on the facepiece external to the hood.

2. The method of claim 1, further comprising removably attaching a protective cover over the filter and the exhalation valve.

3. The method of claim 1, further comprising removably coupling a lens magazine to the facepiece.

4. The method of claim 3, further comprising loading the lens magazine with a plurality of separate lenses.

5. The method of claim 4, wherein loading the lens magazine with a plurality of separate lens comprises inserting a removable tab into each lens, wherein the tab is configured to remove the lens using a gloved hand by a user of the abrasive blast respirator.

6. The method of claim 1, wherein removably attaching the exhalation valve into the exhalation valve port comprises screwing the exhalation valve into place.

7. The method of claim 6 wherein the exhalation valve comprises a valve cover and an exhalation valve housing, further comprising removably attaching the valve cover to the exhalation valve housing from an outside of the facepiece.

8. The method of claim 1, wherein the hood is operable to cover a user's head and is formed of a flexible material.

9. A method of disassembling a supplied-air abrasive blast respirator, comprising:

detaching a breathing hose from a first inhalation valve, where the first inhalation valve is coupled to a facepiece of an abrasive blast respirator external to a hood;

detaching a filter from a second inhalation valve, where the second inhalation valve is coupled to the facepiece external to the hood; and removing the facepiece out of a hood assembly of the abrasive blast respirator.

10. The method of claim 9, further comprising removing a housing of the exhalation valve from an inside of the facepiece.

11. The method of claim 10, further comprising cleaning the valve and housing of the exhalation valve and cleaning the breathing hose.

12. The method of claim 9, further comprising removing a protective cover positioned over the filter and the point of attachment of the breathing hose to the first inhalation valve.

13. The method of claim 9, further comprising detaching a second filter from a third inhalation valve, where the third inhalation valve is coupled to the facepiece.

14. The method of claim 9, further comprising removing a lens magazine from the outside of the facepiece.

15. A method of assembling a supplied-air abrasive blast respirator, comprising:

removably installing a full facepiece assembly into a hood, wherein the full facepiece assembly comprises a lens, a face seal, and a head harness;

removably attaching a protective cover to an outside of the full facepiece assembly external to the hood and over a plurality of inhalation valves and an exhalation valve; and removably attaching a lens magazine assembly to the lens after the full facepiece assembly is installed into the hood.

16. The method of claim 15, further comprising assembling the lens magazine assembly by snapping an inner lens to a carrier lens;

snapping a middle lens to the carrier lens over the inner lens; and snapping an outer lens to the carrier lens over the middle lens.

17. The method of claim 15, further comprising:

attaching a filter to a first inhalation valve before removably attaching the protective cover to the outside of the full facepiece assembly, where the first inhalation valve is coupled to the lens external to the hood; and attaching a breathing hose into a second inhalation valve before snapping the protective cover to the outside of the full facepiece assembly, where the second inhalation valve is coupled to the lens external to the hood.

18. The method of claim 15, further comprising snapping an exhalation valve housing, a seal, and an exhalation valve together, fitting the exhalation valve housing into a receiving aperture in the lens from an inside of the lens; and snapping a valve cover to the exhalation valve housing from an outside of the lens.

19. The method of claim 15, wherein the hood is operable to entirely cover a user's head and comprises a flexible, abrasion resistant material.

* * * * *